US010480818B1

(12) United States Patent
Peters

(10) Patent No.: US 10,480,818 B1
(45) Date of Patent: Nov. 19, 2019

(54) IMMERSIBLE BATH UNIT AND SYSTEM

(71) Applicant: Laura Marie Peters, Sunny Isles Beach, FL (US)

(72) Inventor: Laura Marie Peters, Sunny Isles Beach, FL (US)

( * ) Notice: Subject to any disclaimer, the term of this patent is extended or adjusted under 35 U.S.C. 154(b) by 0 days.

(21) Appl. No.: 16/294,429

(22) Filed: Mar. 6, 2019

(51) Int. Cl.
*F24H 1/00* (2006.01)
*F24H 1/06* (2006.01)
*H05B 3/80* (2006.01)

(52) U.S. Cl.
CPC ..... *F24H 1/0081* (2013.01); *F24H 1/06* (2013.01); *H05B 3/80* (2013.01); *F24H 2250/02* (2013.01); *H05B 2203/021* (2013.01)

(58) Field of Classification Search
CPC ..... A61H 2033/0037; A61H 2033/005; A61H 33/005; A61H 33/0095; A61H 33/0087; A61H 2201/0207; A61H 2201/5082; A61H 2201/0228; A61H 2201/5007; A61H 2201/5048; A61H 2201/0204; A61H 2201/0054; F24H 9/2028; F24H 9/2007; F24H 9/2017; F24H 1/0081; F24H 1/06; F24H 1/20; F24H 2205/02; H05B 3/80; H05B 3/78; H05B 2203/021
See application file for complete search history.

(56) References Cited

U.S. PATENT DOCUMENTS 5,242,582 A 9/1993 Marioni
5,822,808 A 10/1998 Esser
6,375,090 B1 4/2002 Beidokhti
6,782,567 B1 8/2004 Austin et al.
9,066,632 B2 6/2015 Millerd
10,010,800 B2 7/2018 Weisman et al.
2006/0112953 A1* 6/2006 Gougerot ..... A61H 33/005 126/374.1
2006/0143818 A1 7/2006 Bickmore et al.
2009/0126100 A1* 5/2009 Kenoyer ..... F24H 1/0081 4/559

FOREIGN PATENT DOCUMENTS

CN 2289502 9/1998
CN 107518793 12/2017
JP 2006061360 3/2006
(Continued)

OTHER PUBLICATIONS

Electra, "Electra 3150S SafeHete All-Purpose 5-½ in. and 11-½ in. Portable Electric Water Heater Insulated Handle", last downloaded from https://www.amazon.com/11-1-Water-Depth-Heater-Electra/dp/B000R051DE on Mar. 5, 2019.
(Continued)

*Primary Examiner* — Shawntina T Fuqua
(74) *Attorney, Agent, or Firm* — The Concept Law Group; Scott D. Smiley; Scott M. Garrett

(57) ABSTRACT

An immersible bath unit is configured to be submerged in a bathtub while a user takes a bath in the bathtub, and to provide a source of heat to reduce the rate at which the bath water would otherwise cool naturally. The immersible bath unit is battery powered to eliminate the risk of electric shock associated with water heaters powered by commercial AC electric service.

20 Claims, 9 Drawing Sheets

(56) References Cited

FOREIGN PATENT DOCUMENTS

| | | |
|---|---|---|
| JP | 2013088083 | 5/2013 |
| WO | 2014195940 | 12/2014 |

OTHER PUBLICATIONS

Home Depot, "Pure Clean Battery-Powered Handheld Portable Shower Cleaning System Built-In Rechargeable Battery", last downloaded from https://www.homedepot.com/p/Pyle-Pure-Clean-Battery-Powered-Handheld-Portable-Shower-Cleaning-System-Built-In-Rechargeable-Battery-PCSHPT12/305648303? on Mar. 5, 2019.
alibaba.com, "Shower heater wall mounted electric water head tankless battery powered shentai solar", last downloaded from https://www.alibaba.com/product-detail/Shower-heater-wall-mounted-electric-water_60781761860.html? on Mar. 5, 2019.
Jacuzzi, "ProLink App", last downloaded from https://www.jacuzzi.com/en-us/hot-tubs/products/accessories/prolink-app on Mar. 5, 2019.
Moen, "U by Moen Smart Shower", last downloaded from https://www.moen.com/whats-new/innovation/u#benefits on Mar. 5, 2019.
Home Depot, 10 in.×4 in. In-Line Heater for Whirlpool, last downloaded from https://www.homedepot.com/p/American-Standard-10-in-x-4-in-ln-Line-Heater-for-Whirlpool-9ILH/202518171 on Oct. 3, 2018.

* cited by examiner

IMMERSIBLE BATH UNIT AND SYSTEM

FIELD OF THE DISCLOSURE

The present disclosure relates generally to portable heating units, and, more particularly, relates to a portable heating unit for use in a bathtub.

BACKGROUND OF THE DISCLOSURE

Many residences have a bathtub, and people often enjoy relaxing by taking a warm bath. A common issue with such activities is that the bath water tends to cool, sometimes rather quickly. Sitting in lukewarm water is not quite as enjoyable or therapeutic as a warm bath. To alleviate the cooling of bath water, people often simply add more hot water. Obviously this requires more water, and, unless water is drained, will change the water level in the bathtub.

There are a number of immersible water/fluid heaters on the market, however most are not suited for use in a bathtub while a person is using the bathtub (e.g. taking a bath). This is because of the risk of electric shock due to such devices being powered by standard household electric service (120+ volts AC). An alternative approach pumps water out of the bathtub through one pipe, into a separate unit containing a heating element, and the heated water is then returned through another pipe back into the bathtub. This approach removes the risk of electric shock, but is unnecessarily complex and risks spilling water outside the bathtub. Such devices are also not easy to clean.

Therefore, a need exists to overcome the problems with the prior art as discussed above.

SUMMARY OF THE DISCLOSURE

The disclosure provides an immersible bath unit that overcomes the hereinafore-mentioned disadvantages of the heretofore-known devices and methods of this general type and that avoids the risk of electric shock while being able to maintain bath water at a desired temperature range and greatly reduce, if not eliminate, the rate at which the bath water cools naturally.

Among the inventive embodiments described herein, there is provided an immersible bath unit which includes a housing having a sealed interior space and a duct through the housing having intake opening and an output opening. The immersible bath unit further includes an impeller disposed in the duct that is configured to drive water through the duct. The immersible bath unit further includes a heating element further disposed in the duct that is configured to heat water driven through the duct. The immersible bath unit can further include a battery disposed inside the sealed interior space which is configured to provide power to the impeller and heating element. The immersible bath unit can further include an interface circuit configured to receive input from a user, and a controller that is configured to control operation of the impeller and heating element in response to user input received by the interface circuit.

In another feature, the interface circuit is a wireless interface circuit that is configured to communicate using a personal area networking protocol.

In another feature, there is further included features configured to hold a removable filter in the duct.

In another feature, the housing is circular, and the duct follows at least a partial circular path within the housing around a central core of the bath unit which includes the sealed interior space.

In another feature, the heating element is disposed in the duct on a surface of the central core within the duct.

In another feature, there is further included an inductive charging circuit configured to charge the battery and which comprises a coil disposed in a plane parallel to a plane of a bottom surface of the immersible bath unit.

In another feature, the battery is configured to have a maximum voltage of less than 12 volts.

In another feature, the battery is configured to have a maximum voltage of less than 5 volts.

In another feature, there is further included an infusion well form in fluid communication with the duct, and an access panel formed on an outside surface of the housing configured to allow access to the infusion well.

Among the inventive embodiments described herein, there is also provided an immersible bath unit that includes a housing having an exterior housing and a sealed interior space within the exterior housing. There is included a duct within the exterior housing that has an intake opening and an output opening formed on the exterior housing. The immersible bath unit can further include an impeller disposed in the duct configured to move water through the duct, and a heating element disposed in the duct that is configured to heat water moved through the duct. The immersible bath unit can further include a battery disposed inside the sealed interior space which is configured to provide power to the impeller and heating element. The immersible bath unit can further include an inductive charging circuit configured to provide charge to the battery when the immersible bath unit is placed on an inductive charging unit outside of the bathtub, and an interface circuit configured to receive input from a user. The interface circuit can include a wireless interface circuit that is configured to communicate using a personal area networking protocol. The immersible bath unit can further include a controller configured to control operation of the impeller in response to user input received by the interface circuit.

In another feature, there is further included features configured to hold a removable filter in the duct.

In another feature, the housing is circular, and the duct follows a circular path within the housing around a central core.

In another feature, the heating element is disposed in the duct on a surface of the central core within the duct.

In another feature, the inductive charging circuit comprises a coil disposed in a plane parallel to a plane of a bottom surface of the immersible bath unit.

In another feature, there is further included an infusion well in fluid communication with the duct, and an access panel formed on an outside surface of the housing configured to allow access to the infusion well.

Among the inventive embodiments described herein, there is also provided an immersible bath unit that includes an exterior housing having a duct formed therein, the duct being formed between an intake port formed through the exterior housing and an outlet port formed through the exterior housing. The immersible bath unit can further include an impeller disposed within the duct that is configured to move water through the duct from the intake port and out through the outlet port. The immersible bath unit can further include a heating element disposed in the duct that is configured to heat water in the duct as the water is moved by the impeller through the duct, and a battery that is configured to provide power to the impeller and to the heating element. The immersible bath unit can further include an interface circuit configured to receive input from a user of the immersible bath and control power from the battery to the impeller and heating element in accordance with the input.

In another feature, the immersible bath unit has a negative buoyancy in water.

In another feature, there is further included an inductive charging coil that is configured to provide charge to the battery.

In another feature, there is further included a base including a transmit coil that is configured to transmit electrical energy inductively to the inductive charging coil.

In another feature, there is further included a filter holder and an infusion well provided in the duct, and an access cover provided on the exterior housing which covers an access opening that is configured to provide user access to the filter and the infusion well.

Although the embodiments are illustrated and described herein as embodied in an immersible bath unit, it is, nevertheless, not intended to be limited to the details shown because various modifications and structural changes may be made therein without departing from the spirit of the disclosure and within the scope and range of equivalents of the claims. Additionally, well-known elements of exemplary embodiments will not be described in detail or will be omitted so as not to obscure the relevant details of the disclosure.

Other features that are considered as characteristic for the invention are set forth in the appended claims. As required, detailed embodiments of the present disclosure are disclosed herein; however, it is to be understood that the disclosed embodiments are merely exemplary of the disclosure, which can be embodied in various forms. Therefore, specific structural and functional details disclosed herein are not to be interpreted as limiting, but merely as a basis for the claims and as a representative basis for teaching one of ordinary skill in the art to variously employ the present disclosure in virtually any appropriately detailed structure. Further, the terms and phrases used herein are not intended to be limiting; but rather, to provide an understandable description of the disclosure. While the specification concludes with claims defining the features of the disclosure that are regarded as novel, it is believed that the disclosure will be better understood from a consideration of the following description in conjunction with the drawing figures, in which like reference numerals are carried forward. The figures of the drawings are not drawn to scale.

Before the embodiments are disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present disclosure and simplify the description, but not to indicate or imply that the devices or components must have a specific azimuth, or be constructed or operated in the specific azimuth, which thus cannot be understood as a limitation to the embodiments of the present disclosure. Furthermore, terms such as "first", "second", "third" and so on are only used for descriptive purposes, and cannot be construed as indicating or implying relative importance.

In the description of the embodiments of the present disclosure, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present disclosure.

DETAILED DESCRIPTION

Figure 1:
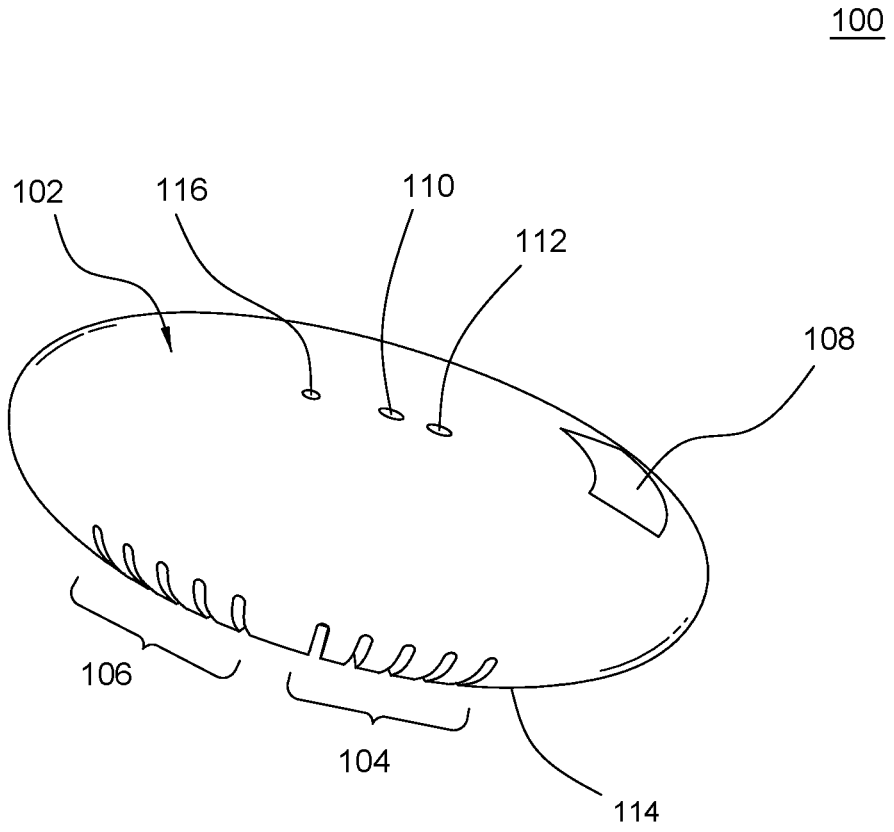
FIG. 1 is a side perspective view of an immersible bath unit, in accordance with some embodiments.

While the specification concludes with claims defining the features of the disclosure that are regarded as novel, it is believed that the disclosure will be better understood from a consideration of the following description in conjunction with the drawing figures, in which like reference numerals are carried forward. It is to be understood that the disclosed embodiments are merely exemplary of the disclosure, which can be embodied in various forms.

FIG. 1 is a side perspective view of an immersible bath unit 100, in accordance with some embodiments. The immersible bath unit 100 is designed to be placed into a bath while a person is in the bath, hence it is preferable to have a rounded shape, avoiding sharp corners or edges. As used here, the term "immersible" is meant to indicate that the bath unit can be submerged in water, and specifically in bath water, when operating. The immersible bath unit 100 can have a negative buoyancy so that it will sink in the bath and rest on a substantially flat bottom surface 114, and a housing 102 through which is formed a duct or water channel, and which includes a sealed interior space to house components that are to be kept dry, such as electronics and a battery power source. In general, the immersible bath unit 100 circulates bath water through it, and can add heat into the water. The intent is not necessarily to raise the average temperature of the bath water so much as to maintain the temperature of the water, or at least reduce the rate at which it cools. Accordingly, the immersible bath unit 100 includes an intake opening 104 through which water is drawn into a duct of channel though the intake opening 104, circulated through the duct, and then expelled through an output opening 106. As the water passes through the duct in the immersible bath unit 100, it can be treated in several ways. For one, heat can be added to the water by a heating element disposed in the duct through which water is drawn and driven. In some embodiments the immersible bath unit can include a filter in the duct to filter any particular matter that may be in the bath water. In some embodiments a bath additive can be diffused (dissolved) into the bath water as it circulates through the immersible bath unit. A filter cartridge and an infusion well can be accessed, for example, through an access hatch cover 108. Furthermore, the immersible bath unit 100 can include one or more light elements 110, 112 that can be used to illuminate the bath water with a selected color or colors, or changing colors.

Once a bath is drawn, the immersible bath unit can be placed in the bath and activated by a user to maintain a desired heat level in the water, or alternatively to add heat into the water to reduce the rate at which the bath cools due to losses through water-air convection and evaporation. In some embodiments the immersible bath unit can sense an initial temperature of the water and adjust the power provided to the heating element in response to limit a thermal difference between the temperature of the bath water in general and the temperature of the water being output by the immersible bath unit. An external temperature sensor 116 can be used to sense the temperature of the bath water outside of the bath unit 100 and provide an indication of the temperature that can be recorded by a controller. In some embodiments the bath unit can record the temperature over time to allow a user to select an optimum temperature setting or to allow the bath unit 100 to moderate its heating of the bath water, or both.

Figure 2:
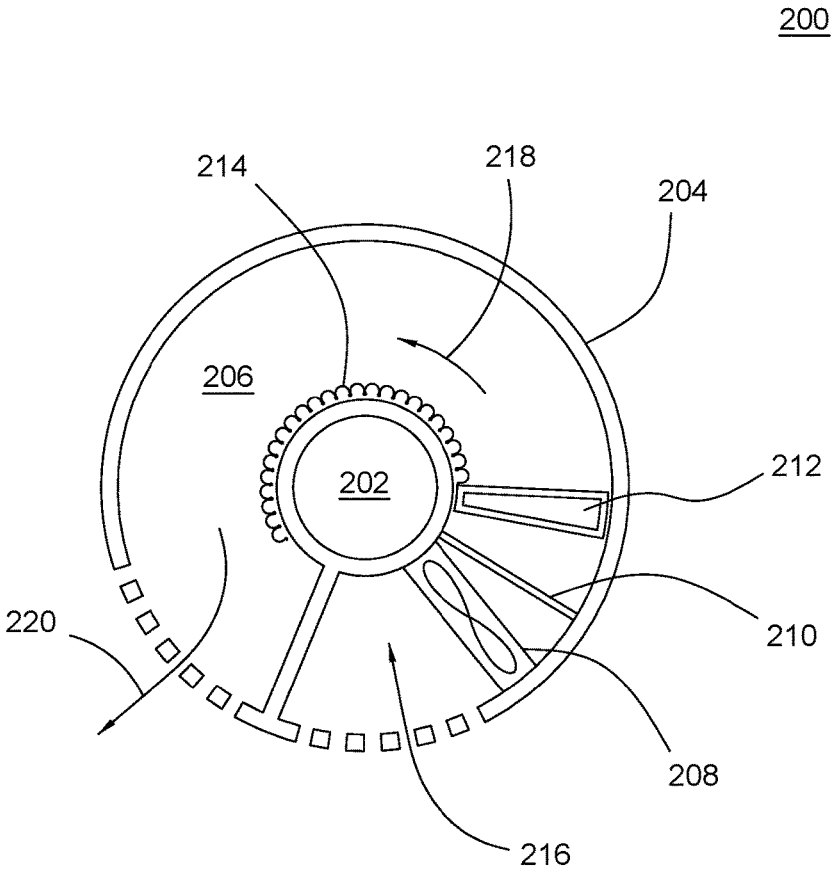
FIG. 2. is a top plan view of a cross section of an immersible bath unit, in accordance with some embodiments.

FIG. 2. is a top plan view of a cross section of an immersible bath unit 200, in accordance with some embodiments. The immersible bath unit 200 can be substantially similar to, or the same as that shown in FIG. 1. The immersible bath unit 200 includes an exterior housing 204 around a central core 202 with a duct 206 defined between the exterior housing 204 and the core 202. The duct 206 is an enclosed space within the exterior housing 204 through which water is moved by an impeller 208. The core 202 can form a sealed interior space that houses circuitry and a power source (battery) for powering the circuitry and the impeller 208. The sealed interior space is sealed and inaccessible to the user. For example, the battery and other electrical components and electronics that need to remain dry can be disposed in the core and sealed therein by any known means, including adhesives, ultrasonic welding, and so on. In some embodiments it is contemplated that the battery can be a primary battery (e.g. non-rechargeable) comprising one or more battery cells, which can be placed in a sealable battery compartment. The compartment can be sealed with a watertight gasket around a battery compartment cover.

Upon being activated, the impeller begins turning to draw water in through an intake, as indicated by arrow 216. The water can be forced through a filter 210 which can be configured to trap matter such as hair, as well as to prevent object from passing into the rest of the duct 206. The filter is held in place by a filter holder, which can be formed by protrusions in the duct against which a filter cartridge or other filter element can bear against to hold the filter in place. The water can also pass through an infusion well 212 that can hold a dissolving solid matter that adds fragrance, oils, soap, or other similar bath materials. As the water passes through the duct 206 in the direction of arrow 218, the water can be heated by a heating element 214. As shown here the heating element can be disposed around the outside of a portion of the core 202 or distributed through the duct 206. The water, carrying additional heat and/or bath materials then exits the bath unit through an output as indicated by arrow 220. In the embodiments of FIG. 2, the duct 206 follows a circular path around the core 202, but it is contemplated that other embodiments can use different shaped ducts, such as a linear duct where water comes in at one end of the bath unit and exits at an opposite side of the bath unit. It will further be appreciated by those skilled in the art that it is preferable to have a grate or similar structure at the intake and output to restrict objects or a person's toes or fingers from entering the bath unit.

Figure 3:
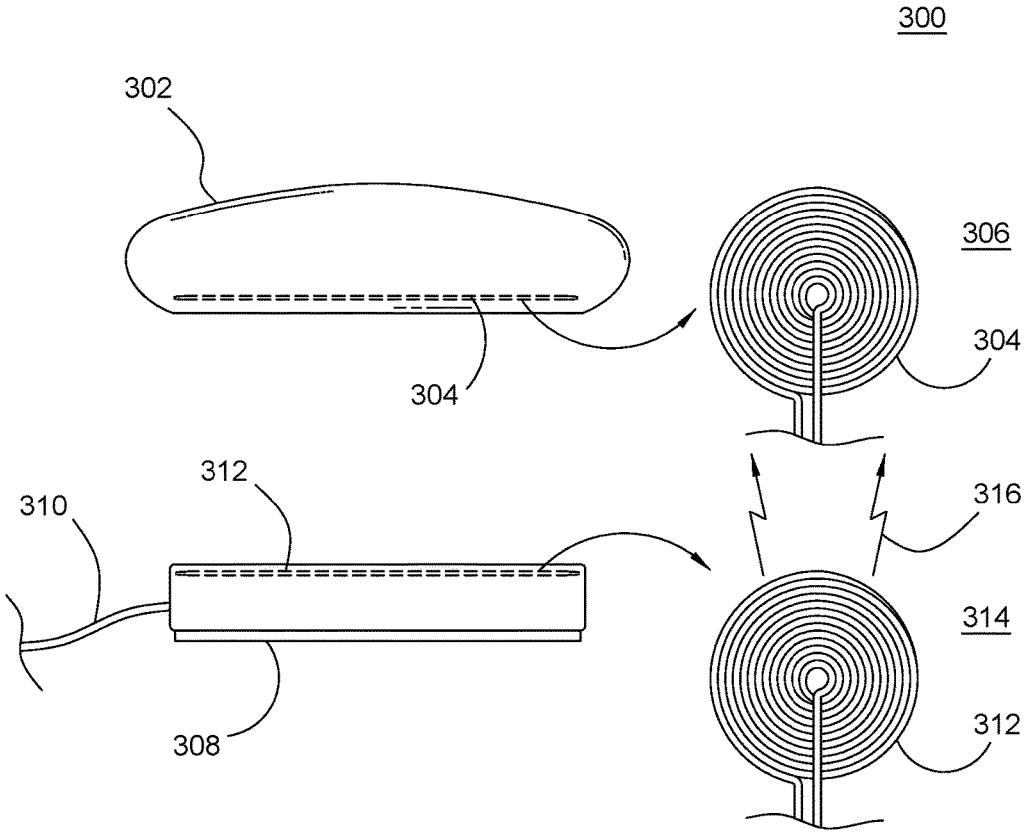
FIG. 3 is a side view of an immersible bath unit and a corresponding charging and storage base, in accordance with some embodiments.

FIG. 3 is a side view 300 of an immersible bath unit 302 and a corresponding charging and storage base 308, in accordance with some embodiments. The immersible bath unit 302 and the base 308 can be considered to be a system. The immersible bath unit 302 contains electronic and electric components as well as a battery power source that are sealed within the bath unit 302 to keep those components dry. Further, to avoid exposure of the power source's voltage and electric current to the bath water, there is no external plug to connect to the battery in order to charge the battery. Instead the bath unit 302 includes a flat pickup coil 304 that is configured to inductively couple to a flat transmit coil 312 in the base 308. The base 308 can be connected to a power source such as commercial household electric service by a cord 310. Electricity is then converted to a suitable AC wave form that is supplied to the flat transmit coil 312 to generate a time-changing electromagnetic field 316, which is picked up by the flat pick up coil 304 in the bath unit 302. The electric power output by the flat pickup coil can then be rectified and converted to a DC source for charging the battery inside the bath unit. View 306 shows a bottom/top view of the flat pickup coil 304, and view 314 shows a similar view of flat transmit coil 312. The base 308 can be sized and configured to locate the bath unit 302 directly over the flat transmit coil 312 to optimize the electromagnetic coupling between the coils 304, 312. The base 308 and the bath unit 302 can also communicate over a link between the coils 304, 312 so that the bath unit 302 can inform the base 308 when the battery is fully charged.

Figure 4:
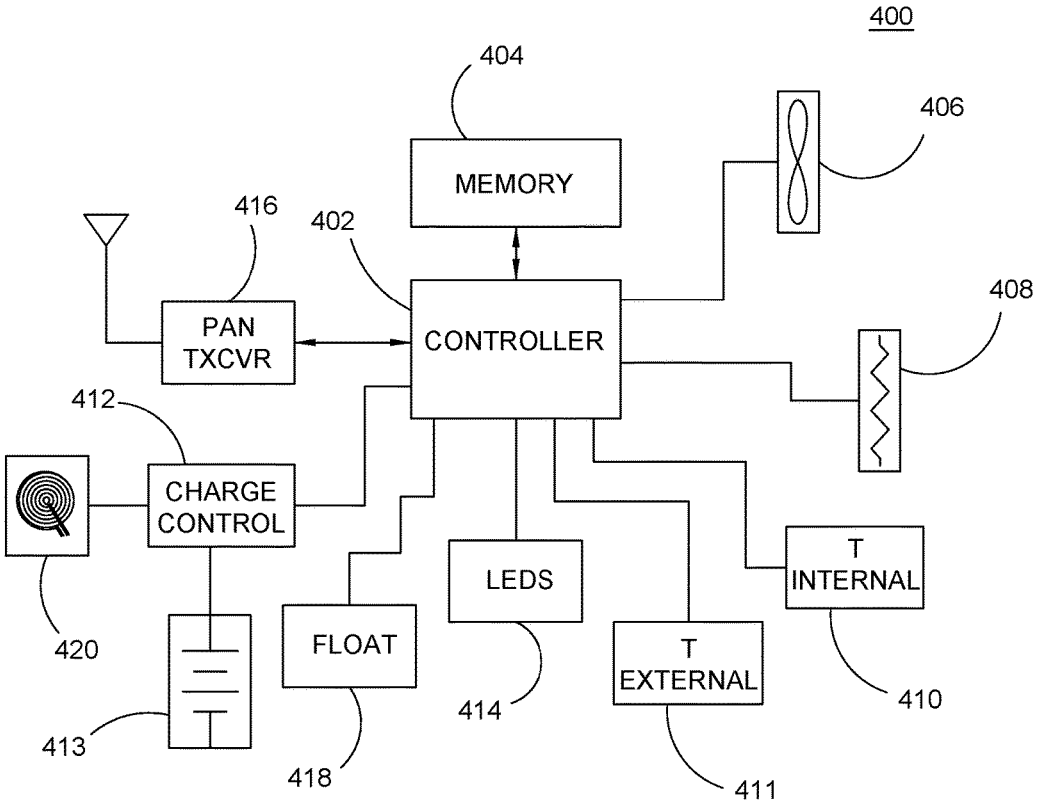
FIG. 4 is a block schematic diagram of circuitry for an immersible bath unit, in accordance with some embodiments.

FIG. 4 is a block schematic diagram of circuitry for an immersible bath unit 400, in accordance with some embodiments. The bath unit 400 includes a controller 402 which can be, for example, a microprocessor or microcontroller, which is coupled to a memory 404. The memory 404 can contain instruction code that is executed by the controller 402 to carry out the functions and processes described herein, as well as other functions. The memory 404 can include both memory for storing instruction code executed by the controller 402 as well as scratch pad, random access memory for storing data, setting timers, and other functions. The controller 402 is coupled to, and controls an impeller circuit 406. The impeller circuit 406 includes and impeller that is disposed in the duct through the bath unit, as well as switching circuitry to turn the impeller on and off, and to control the speed of the impeller. The controller 402 is further coupled to a heating element circuit 408 that includes a heating element disposed in the duct of the bath unit, and further includes circuitry for controlling an electric current through the heating element to adjust the heat output of the heat element. The heat element can be, for example, a resistive heating element such that electric current through the heating element generates heat generally in proportion to the electric current. To monitor the temperature of the water being heated by the bath unit 400, an internal thermal sensor 410 can be located in the duct of the bath unit, near the output of the duct or at another location. The internal thermal sensor 410 can produce an electrical signal corresponding to it temperature that is sensed by the controller 402 such as by an analog to digital converter. In some embodiments the internal thermal sensor 410 can include a thermistor or thermocouple. Similarly, an external thermal sensor 411 can be mounted on an external surface/exterior of the bath unit to monitor the bath water temperature. The bath water temperature, as sensed by the external thermal sensor 411 can be used to produce an indication of the bath water outside of the bath unit 400 to facilitate control of the operation of the heating element 408 and to allow the controller 402 to create a record of temperature over time during use of the bath unit. In some embodiments, the external thermal sensor 411 can be used to periodically sense the bath water temperature to create charts to display to the user, allowing the user to see how effective the bath unit is at maintaining bath water heat and reducing the cooling rate of the bath water.

A charge control circuit 412 is operably coupled to the controller 402 as well, and in addition to other operations, applies a charge regime to the battery 413. The battery is charged by controller electric current and voltage produced by a flat pickup coil 420 in the presence of an electromagnetic field produced by the base. The battery can be similar to those used in laptop computers, where the voltage can be less than or equal to twelve volts, nominally, or less than five volts. The battery, being rechargeable, will have a variable voltage depending on charge level of the battery, temperature, and age. The charge control circuit 412 can also track the amount of charge in the battery 413 so that the charge information can be presented to a user. For example, the controller 402 can operate one or more light elements such as light emitting diodes (LEDs) 414 to indicate a charge level of the battery 413. The controller 402 can also control operation of the LEDs to achieve a light effect, such as changing or blending colors produced by the LEDs 414.

In order to allow a user to control operation of the bath unit, a wireless personal area networking (PAN) transceiver 416 can be provided, and which can operate according to specifications set forth by the Institute of Electrical and Electronics Engineers (IEEE) in specifications 802.11 or 802.15. In some embodiments the PAN transceiver 416 can operate according to the other interface protocol known commercially as BlueTooth, and can connect to another device that runs an application program designed to provide a user interface to control the bath unit 400. Using the user's device (e.g. phone, tablet) the user can check charge status, turn on the bath unit, select a heat setting, select a light setting, and so on. In order to ensure that the bath unit is in water before activating the heat element, the bath unit can further include a float sensor 418 that indicates when the bath unit is submerged. The float sensor can simply detect the presence of water via a change in an electrical parameter (e.g. resistance, capacitance) between two sensor electrodes, or it can employ a buoyant member that triggers a switch when the bath unit is submerged.

Figure 5:
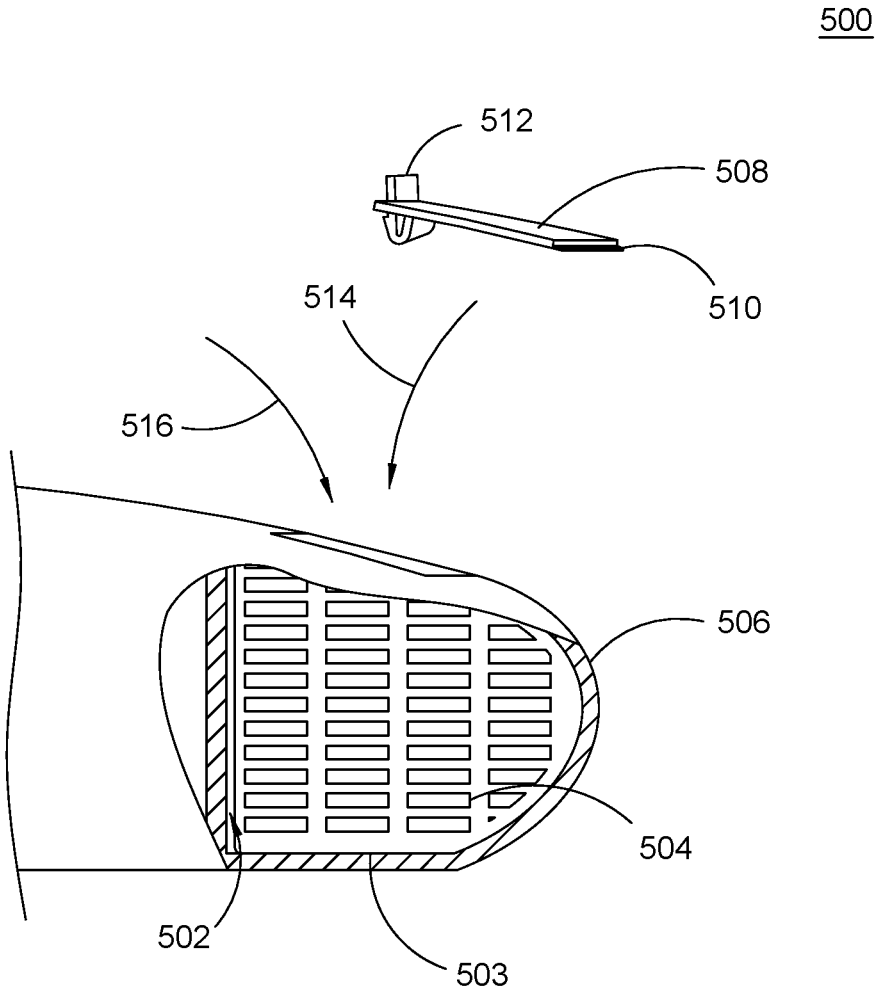
FIG. 5 is a side cutaway view of a duct of an immersible bath unit, showing a bath additive basket for infusing bath additives in a bath, in accordance with some embodiments.

FIG. 5 is a side cutaway view of a duct 502 of an immersible bath unit 500, showing a bath additive basket 503 or infusion well for infusing bath additives in a bath, in accordance with some embodiments. The basket 503 can be substantially similar to the infusion well 212 of FIG. 2. The basket includes a plurality of openings 504 that allow water to flow through the basket and interact with material placed in the basket 503 by a user. The basket 503 can rest against a wall 506 of the bath unit and be held in place by a bracket or similar structure. Material, such as bath crystals, can be placed in the basket 503 as indicated by arrow 516. A cover 508 can fit over the basket 503 and have engaging features 510, 512 that engage corresponding features of the bath unit housing to hold the cover 508 in place. Accordingly, and user can add their favorite bath additive into the basket 503 which will be dispersed over time into the bath water as the impeller moves water through the duct 502. The basket 503 can be accessed through an access opening 516 which is covered by the cover 508 or access hatch. The over 508 can be placed over the access opening 516 as indicated by arrow 514 to cover the basket 503, wherein the engaging features 510, 512 will releasably retain the cover 508 in place over the access opening 514. Furthermore, a filter or filter cartridge (e.g. filter 210) can be placed adjacent with the basket 503, in line with the basket 503 so that water moved by the impeller passes through both the filter and the basket 503.

Figure 6:
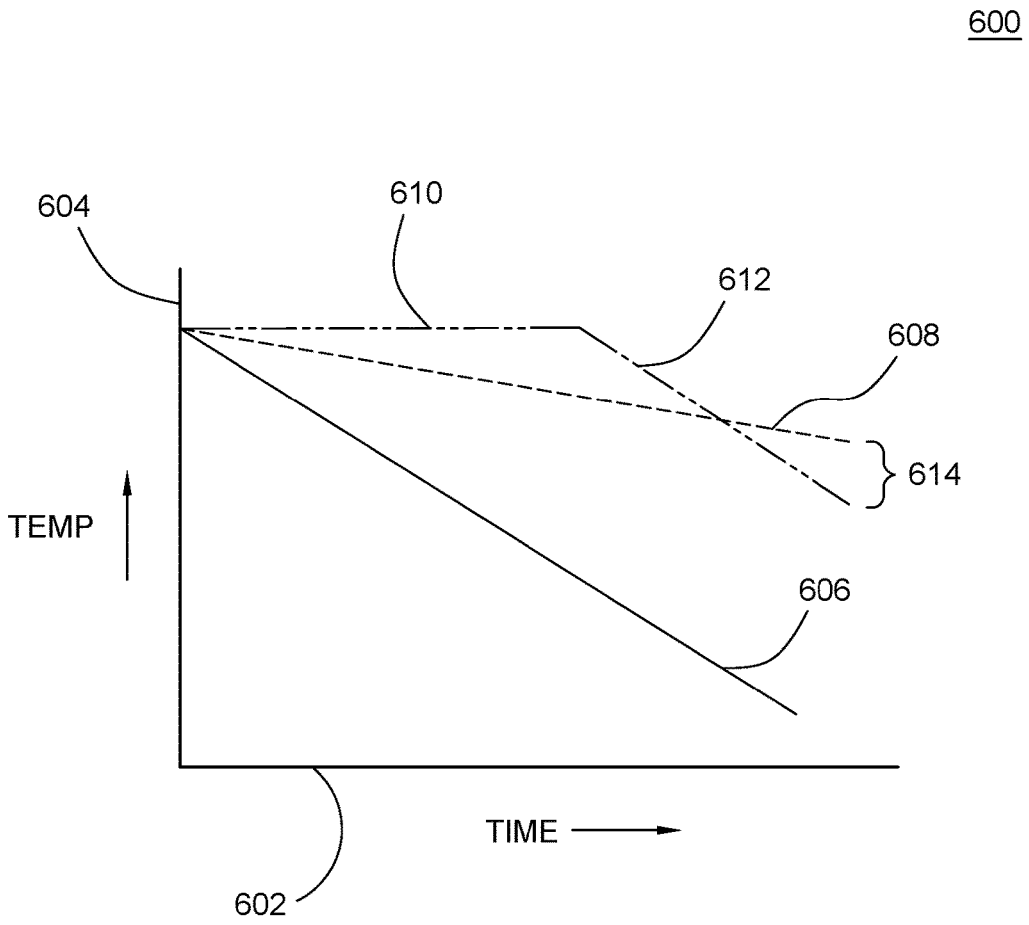
FIG. 6 shows a graph chart of temperature over time for bath water with and without use of an immersible bath unit, in accordance with some embodiments.

FIG. 6 shows a graph chart 600 of temperature over time for bath water with and without use of an immersible bath unit, in accordance with some embodiments. The horizontal axis 602 represents time, and the vertical axis 604 represents temperature of bath water. A first plot line 606 represents the temperature over time of a bath without use of an immersible bath unit, where the natural cooling occurs over time. A second plot line 608 represents a similar bath (in water volume, surface area, ambient temperature, etc.) where an immersible bath unit is used to reduce the rate at which the bath water cools where the immersible bath unit is set at a moderate temperature setting. A third plot line 610 shows the use of an immersible bath unit in a similar bath where the user uses a higher temperature setting. Initially the bath water is maintained close to a constant temperature, but because of the high heat output required to do so, the battery can lose charge and in portion 612 the bath unit is no longer able to provide heat and the water cools at the same rate as plot line 606. As a result, at the end of the bath, the higher heat setting can still result in a lower bath temperature by a difference 614 at the end time. Accordingly, by recording temperature over time, a user can learn to select an optimized temperature setting for an expected duration of a bath to minimize cooling for the duration of the bath. In some embodiments it is contemplated that the bath unit can gradually reduce the power provided to the heating element during usage, gradually, or at intervals, to reduce the load on the battery and prolong usage time.

Figure 7:
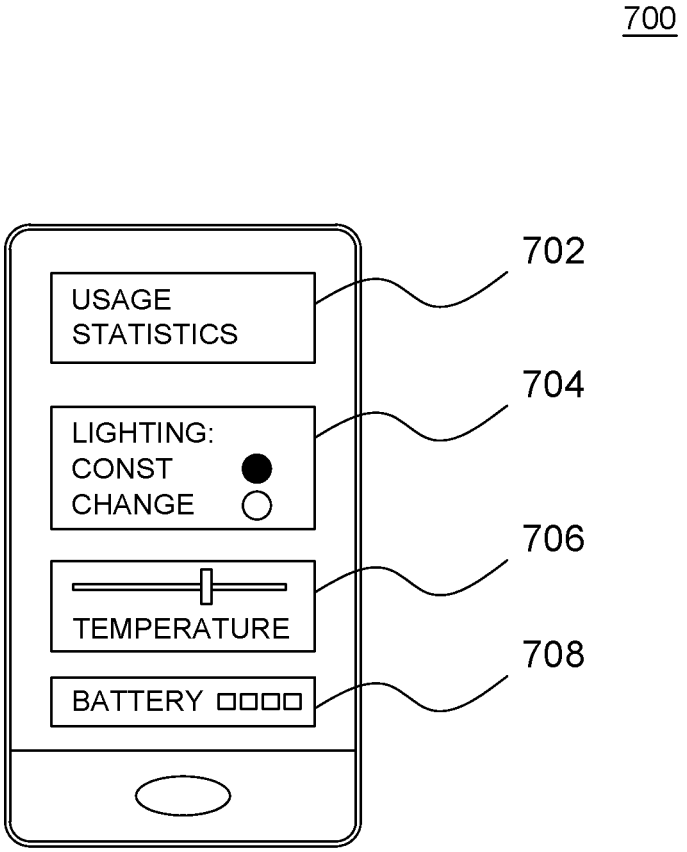
FIG. 7 shows an application program interface on a device communicatively linked to an immersible bath unit, in accordance with some embodiments.

FIG. 7 shows an application program interface on a device 700 communicatively linked to an immersible bath unit, in accordance with some embodiments. The device can be any suitably enabled device, such as a cellular telephone device or similar mobile computing device, a tablet computing device, and so on. The device 700 can include a PAN transceiver to wirelessly link to the PAN transceiver of the bath unit. Some exemplary options that can be displayed and provided to a user include usage statistics 702, which, upon selecting, and cause the application program to display another interface screen showing a record of path usages of the bath unit. A lighting selector 704 can be presented to allow a user to select, for example, a constant light or a changing light. Various lighting patterns and color variations can be provided, as is known. A temperature selector 706 can be provided to allow a user to select a temperature setting used to control the heating element in the bath unit. A battery indicator 708 can display a battery charge status of the battery in the bath unit. These and other options can be provided by the application program to allow a user to control the bath unit, as well as to see historical usage of the bath unit. Once the user has selected the desired settings, the setting information can be transmitted to the immersible bath unit via the interface circuit of the immersible bath unit so that the controller of the immersible bath unit can adjust operation of the immersible bath unit accordingly.

Figure 8:
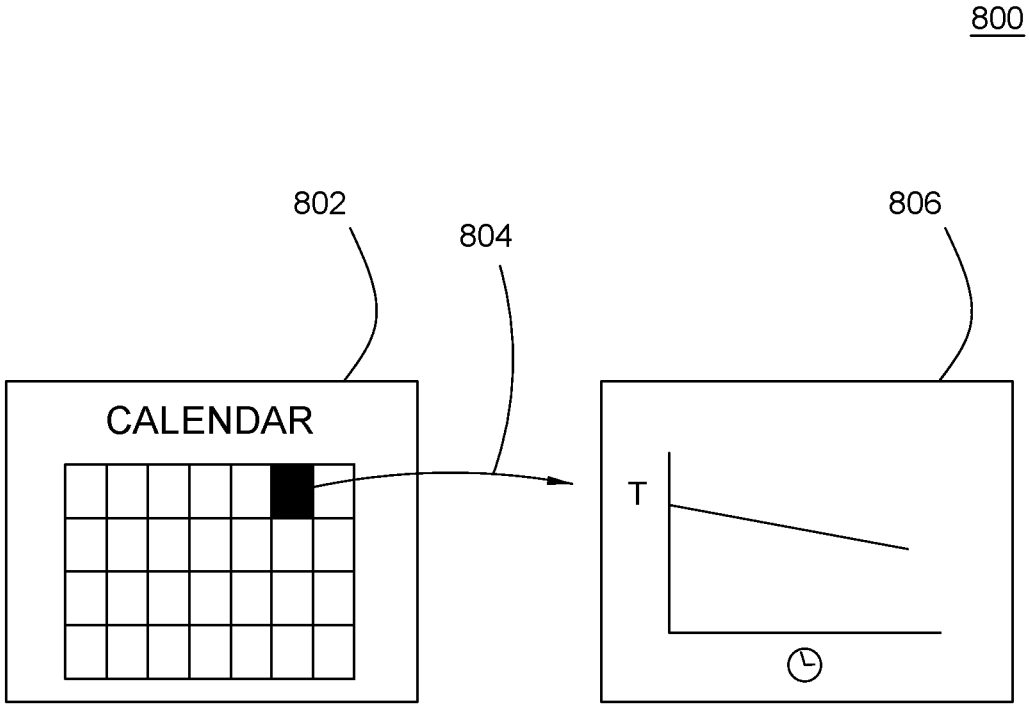
FIG. 8 shows a display of a bathing record calendar and a graph chart of temperature over time for a bath that occurred on a selected day of the calendar, in accordance with some embodiments.

FIG. 8 shows a display 800 of a bathing record calendar 802 and a graph chart 806 of temperature over time for a bath that occurred on a selected day of the calendar, in accordance with some embodiments. In some embodiments, the user can select, on their linked device that is connected to the bath unit, and interface option to see historical usage of the bath unit, which results in the calendar (or a similar interface element) 802 being displayed. Days on which the bath unit has been used can be indicated in the calendar 802, and made selectable in the interface of the application program. Upon selecting a given day, a display of the graph chart 806 can be presented which shows the temperature over time of the bath which occurred on the selected day.

Figure 9:
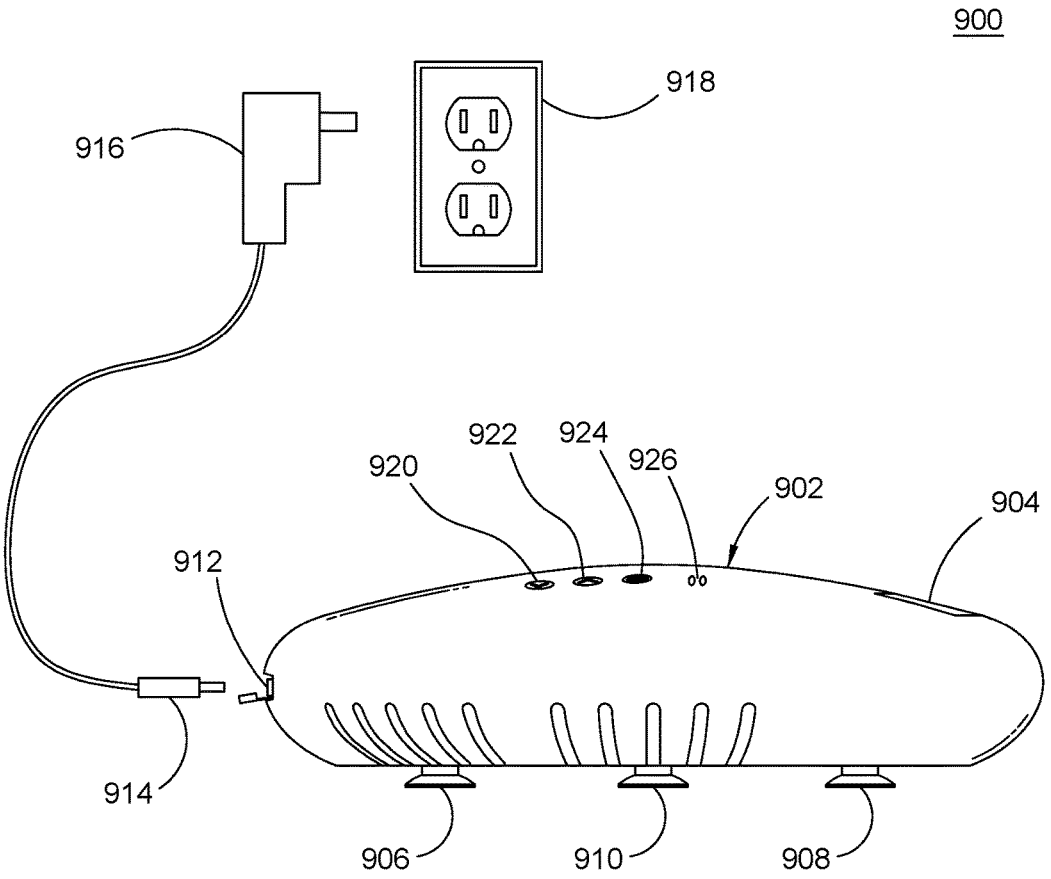
FIG. 9 is a side elevational view of an immersible bath unit, in accordance with some embodiments.

FIG. 9 is a side elevational view of an immersible bath unit 900, in accordance with some embodiments. The bath unit 900 include an exterior housing 902 which can include an access port 904 for filters and an infusion well, as previously described. The bath unit can operate substantially as previously described, including a heating element disposed in an internal duct through which the bath unit moves water to add heat to the water. The electronics and other circuity inside the bath unit are located inside sealed, watertight spaces inside the bath unit. In some embodiments as exemplified here, the bath unit can include one or more suction cups 906, 908, 910 to hold the bath unit in place on the bottom of a bath tub while the bath unit is submerged in the bath. In some embodiments three suction cups placed in a triangular formation are preferred to support the bath unit and prevent it from wobbling when attached to the bath tub. In some embodiments the bath unit can have a positive buoyancy, and the suction cups 906, 908, 910 can be used to keep the bath unit 900 submerged. In embodiments that utilize inductive charging, the suction cup(s) 906, 908, 910 can be removable so that the bottom of the bath unit 900 can sit flush against the top surface of a base unit (e.g. base 308).

In some embodiments conventional charging of the internal battery can be utilized instead of inductive charging, where a sealed socket 912 is provided to receive an electrical plug 914 of a charging adapter 916. The sealed socket 912 can be sealed to prevent water intrusion into the interior space where the electrical components are disposed, and the contacts of the sealed socket 912 can be diode protected, as is well known, to prevent and reverse discharge through the water of the bath when the bath unit 900 is placed in the bath water. When the bath unit 900 is removed from the bath water, the electrical plug 914 can be inserted into the sealed socket 912. The charging adapter 916 can be connected to a commercial AC outlet 918 to produce a charging current that is provided to the battery of the bath unit 900 through the plug/socket connection. In some embodiments the cord 917 connecting the charging adapter 916 to the electrical plug 914 can be made short, on the order of two feet or less, in order to prevent people from placing the bath unit 900 into the bath water when connected to the charging adapter 916.

Furthermore, in embodiments where the bath unit 900 is not wirelessly connected and is not provided with a wireless transceiver (e.g. transceiver 416) the bath unit can be provided with manual controls for an interface circuit such as, for example, buttons 920, 922 for controlling the speed of the impeller, or the amount of heat provided by the heat element. In some embodiments there can be two sets of buttons such as buttons 920, 922, with one set for controlling the speed of the impeller and the other set for controlling the heat level of the heat element. Button 920 can be for reducing the setting, and button 922 can be for increasing the setting. There can also be a power button 924 which turns the bath unit 900 on or off in a toggle fashion. The button 920, 922, 924 can all be rubber sealed, as is well known for submersible devices. To indicate operating status, one or more light elements 926 can be provided. For example, there can be a power light to indicate the bath unit 900 is turned on, and there can be sets of light elements to indicate the settings of the impeller speed and heat element.

An immersible bath unit has been disclosed that can be placed and used in a bath, while a user is also in the bath, to reduce the rate at which the bath water cools. Because the immersible bath unit is sealed and battery powered using a low voltage battery, there is no risk of electric shock. Furthermore, because the bath unit reduces the cooling rate, the user will not need to periodically add hot water, and as a result, using the bath unit reduces the total water used, and can be, overall, more efficient in providing a warm bath experience. The battery can be sealed inside the bath unit and charged using an inductive charging arrangement with an associated base unit. Furthermore, the bath unit can record temperature over time to store usage records so that users can learn how to adjust the temperature setting to suit their preference.

What is claimed is:

1. An immersible bath unit, comprising:

a housing having a sealed interior space, which remains dry when the immersible bath unit is submerged, and a duct through the housing having intake opening and an output opening with an impeller disposed in the duct configured to drive water through the duct, and a heating element further disposed in the duct that is configured to heat water driven through the duct;

a battery disposed inside the sealed interior space which can provide power to the impeller and heating element;

an interface circuit in the sealed interior space that is configured to receive input from a user; and a controller in the sealed interior space that is configured to control operation of the impeller and heating element in response to user input received by the interface circuit.

2. The immersible bath unit of claim 1, wherein the interface circuit is a wireless interface circuit that is configured to communicate using a personal area networking protocol.

3. The immersible bath unit of claim 1, further comprising features configured to hold a removable filter in the duct.

4. The immersible bath unit of claim 1, wherein the housing is circular, and the duct follows at least a partial circular path within the housing around a central core of the immersible bath unit which includes the sealed interior space.

5. The immersible bath unit of claim 4, wherein the heating element is disposed in the duct on a surface of the central core within the duct.

6. The immersible bath unit of claim 1, further comprising an inductive charging circuit configured to charge the battery and which comprises a coil disposed in a plane parallel to a plane of a bottom surface of the immersible bath unit.

7. The immersible bath unit of claim 1 wherein the battery is configured to have a maximum voltage of less than 12 volts.

8. The immersible bath unit of claim 7, wherein the battery is configured to have a maximum voltage of less than 5 volts.

9. The immersible bath unit of claim 1, further comprising an infusion well formed in the duct, and an access panel formed on an outside surface of the housing configured to allow access to the infusion well.

10. An immersible bath unit, comprising:

a housing having an exterior housing and a sealed interior space within the exterior housing, and a duct within the exterior housing having intake opening and an output opening formed on the exterior housing, further having an impeller disposed in the duct configured to move water through the duct, and a heating element further disposed in the duct that is configured to heat water moved through the duct;

a battery disposed inside the sealed interior space which is configured to provide power to the impeller and heating element;

an inductive charging circuit configured to provide charge to the battery when the immersible bath unit is placed on an inductive charging unit;

an interface circuit configured to receive input from a user, the interface circuit including a wireless interface circuit that is configured to communicate using a personal area networking protocol; and a controller configured to control operation of the impeller in response to user input received by the interface circuit.

11. The immersible bath unit of claim 10, further comprising features configured to hold a removable filter in the duct.

12. The immersible bath unit of claim 10, wherein the housing is circular, and the duct follows a circular path within the housing around a central core.

13. The immersible bath unit of claim 12, wherein the heating element is disposed in the duct on a surface of the central core within the duct.

14. The immersible bath unit of claim 10, further comprising a temperature sensor that provides an indication of temperature outside of the immersible bath unit, and wherein the controller is configured to produce a record of temperature over time during use of the immersible bath unit.

15. The immersible bath unit of claim 10, further comprising an infusion well formed in the duct, and an access panel formed on an outside surface of the housing configured to allow access to the infusion well.

16. An immersible bath unit system, comprising:

an immersible bath unit having:

an exterior housing having a duct formed therein, the duct formed between an intake port formed through the exterior housing and an outlet port formed through the exterior housing, the exterior housing defining an interior space within the exterior housing;

an impeller disposed within the duct configured to move water through the duct from the intake port and out through the outlet port;

a heating element disposed in the duct that is configured to heat water in the duct as the water is moved by the impeller through the duct;

a battery disposed in the interior space within the exterior housing, and sealed within the interior space, and configured to provide power to the impeller and to the heating element; and an interface circuit disposed in the interior space within the exterior housing, and sealed within the interior space, the interface circuit configured to receive input from a user of the immersible bath unit and control power from the battery to the impeller and heating element in accordance with the input.

17. The immersible bath unit system of claim 16, wherein the interface circuit comprises a personal area networking transceiver configured to wireless connect to a mobile computing device that operates an application program that is configured to receive the input from the user and transmit setting information to the immersible bath unit.

18. The immersible bath unit system of claim 16 further comprising an inductive charging coil that is configured to provide charge to the battery.

19. The immersible bath unit system of claim 18, further comprising a base, the base comprising a transmit coil that is configured to transmit electrical energy inductively to the inductive charging coil.

20. The immersible bath unit system of claim 16, further comprising a filter holder and an infusion well provided in the duct, and an access cover provided on the exterior housing which covers an access opening that is configured to provide user access to the filter holder and the infusion well.

* * * * *